US005842460A

United States Patent [19]

Barber

[11] Patent Number: 5,842,460

[45] Date of Patent: Dec. 1, 1998

[54] MULTIPURPOSE BOW GRIP ASSEMBLY

[76] Inventor: Clyde E. Barber, 1500 Peters Creek Rd., Green Cove Springs, Fla. 32043

[21] Appl. No.: 937,350

[22] Filed: Sep. 20, 1997

[51] Int. Cl.[6] ..... F41B 5/00

[52] U.S. Cl. ..... 124/88

[58] Field of Search ..... 124/23.1, 25.6, 124/86, 88

[56] References Cited

U.S. PATENT DOCUMENTS

| | | | |
|---|---|---|---|
| 3,407,799 | 10/1968 | Reynolds | 124/23.1 X |
| 3,517,658 | 6/1970 | Shurts | 124/23.1 |
| 3,538,902 | 11/1970 | Fowkes | 124/88 |
| 4,252,100 | 2/1981 | Rickard | 124/88 X |
| 4,966,124 | 10/1990 | Burling | 124/23.1 |
| 5,469,834 | 11/1995 | Higgins et al. | 124/88 |

*Primary Examiner*—John A. Ricci
*Attorney, Agent, or Firm*—Steven R. Scott

[57] ABSTRACT

A multipurpose archery bow grip assembly characterized by a bow grip mounted on the bow handle by at least two connecting members, which connecting members have a linear portion that may be nonpermanently affixed at a plurality of depths transversely within the bow handle so as to allow the distance of the top and bottom of the bow grip from the bow handle to differ, and which connecting members terminate in ball portions which pivotally mount in sockets provided in the bow grip, one of such sockets being elongated so as to allow the depth at which the connecting members are affixed within the bow handle to be different.

10 Claims, 5 Drawing Sheets

MULTIPURPOSE BOW GRIP ASSEMBLY

BACKGROUND

1. Field of the Invention

This invention relates generally to the field of bows, and more specifically, to the field of bow grip assemblies. In particular, the instant patent teaches the design of a bow grip assembly incorporating features that provide adjustability and assist in eliminating the problem of bow torque. In the preferred embodiment, the structures described herein provide a unique arrangement that, in addition to other desirable features--(a)(i) allow the adjustment of the bow grip toward or away from the bow handle (allowing adjustment of brace height and draw length without changing draw weight or requiring readjustment of the bow), (a) (ii) allow the adjustment of the bow grip for high or low wrist position, while simultaneously (b)(i) allowing the bow grip to be fixed in a rigid position with regard to the bow handle, or (b)(ii) alternatively, allowing the bow grip to be pivoting for anti-torque purposes.

2. Prior Art in the Field

Archery is an ancient art that has, in recent years, witnessed a sudden growth in popularity and innovation. The most notable recent development in bow design has been the invention and continuing refinement of the compound bow. However, numerous innovations have been developed in other areas as well, including changes to the design and arrangement of the bow grip assemblies by which the archer holds the bow.

The modern archery bow is generally comprised of a central riser with a bow handle or portion located therein and an upper and lower limb extending therefrom. The bow string is strung directly between the ends of the upper and lower limbs at points distant from the riser and/or, in the case of compound bows, from various cams and pulleys located at these points. The bow handle often is provided with a bow grip contoured for the archer's hand. In more recent years, the need for anti-torque features and other adjustability features have led to numerous attempts to improve or innovate in the area of bow handles/grips. However, none of the innovations attempted in this area allow the simultaneous adjustment of features necessary to true versatility. Representative examples of prior attempts at producing such versatility may be seen in the following patents:

1. U.S. Pat. No. 3,397,685 issued to B. G. Walker in 1968 for a "Universally Mounted Archery Bow Handle" features an anti-torque pivoting handle/bow grip without means for adjusting for high/low wrist or for adjusting bow brace height/draw length via movement of the bow grip away from the bow handle.

2. U.S. Pat. No. 3,407,799 issued to R. J. Reynolds in 1968 for "Archery Bow and Handgrip Alignment Apparatus Therefor" describes a bow grip that is mounted to the bow handle by a single connecting member with ball fitted to a socket in the hand grip. While it may possibly provide anti-torque pivoting features, it cannot be fixed in any position and lacks means for adjusting bow brace height/draw length.

3. U.S. Pat. No. 3,491,739 issued to D. A. Scrobell in 1970 for an "Archer's Bow" illustrates a anti-torque bow grip/handle fixed in an arcuate member that allows it to be adjusted for high/low wrist position, but does not allow adjustment of bow brace height/draw length and other features.

4. U.S. Pat. No. 3,538,902 issued to Clarence R. Fowkes in 1970 for a "Bow Grip Assembly" describes a simple assembly capable of being inserted into the riser of a bow so as to form an anti-torque pivoting bow grip/handle. However, this assembly lacks means for adjusting for high/low wrist position, or for bow brace height/draw length and other adjustability features.

5. U.S. Pat. No. 4,252,100 issued to Lawrence C. Rickard in 1981 for an "Archery Bow with Movable Handle" teaches the design of an anti-torque pivoting bow grip much like those seen in prior art, but with biasing means biasing said hand grip to a central position. The device illustrated lacks means for adjusting for high/low wrist position, or for bow brace height/draw length and other adjustability features.

6. U.S. Pat. No. 4,966,124 issued to Michael Burling in 1990 for a "Grip Assembly for Archery Bow," U.S. Pat. No. 5,081,979 issued to Michael Burling in 1992 for a "Front Pull Grip Assembly for Archery Bow," and U.S. Pat. No. 5,349,937 issued to Michael Burling in 1994 for a "Torque Free Bow with Improved Handle Grip Assembly" represent more complex failed attempts to solve some of the problems dealt with in this invention Utilizing alternate apparatus, but also lacks the features and abilities developed by the instant invention such as the ability to be fixed in a rigid position.

7. U.S. Pat. No. 5,241,945 issued to Paul Shepley, Jr., in 1992 for an "Archery Bow with Laterally Adjustable Grip" and U.S. Pat. No. 5,243,958 issued to Paul Shepley, Jr., in 1993, illustrate bow grips which may be laterally adjusted. The devices described lack any anti-torque pivoting features. They also lack means for adjusting for high/low wrist position, for adjusting for bow brace height/draw length, or for making other necessary adjustments.

8. U.S. Pat. No. 5,469,834 issued to Ronald Higgins, et al. in 1995 for an "Archery Bow with Tilting and Translating Grip" teaches a bow handle grip which adjusts for different positions, but possesses no anti-torque pivoting features.

9. U.S. Pat. No. 5,551,413 issued to Randy J. Walk in 1996 for an "Archery Bow Handle Riser with Replaceable Grip Heel" teach the design for a bow handle grip that adjusts for high or low wrist position, but does nothing else.

However, none of these patents anticipate or render obvious the design for a versatile multipurpose bow grip assembly of the type taught herein.

SUMMARY AND OBJECTS OF THE INVENTION

The instant patent and previously filed Disclosure Document #411667 teach the design for a multipurpose bow grip that allows simultaneous adjustment of the bow grip for a high or low wrist position while simultaneously preserving anti-torque pivoting features. The unique design described herein also allows adjustment of draw length/brace height and may be fixed in high or low wrist position (or any position in between these two extremes) as well as having the capability of pivoting in those positions. It accomplishes these goals utilizing a design that is efficient and easily adjustable by the user. These objects are effected by the provision of a bow grip that is, in the preferred embodiment described herein, attached to the bow handle using a high/low ball and socket arrangement wherein each connecting member is formed from a ball headed bolt that may be screwed into and out of the bow handle. A first connecting member is positioned so that its ball can be inserted into a socket at the upper end of the bow grip, whereas the second connecting member is positioned so that its ball can be inserted into an elongated socket at the lower end of the bow grip. The elongated socket provides means, not found in prior art, for moving one connecting member in/out without simultaneously moving the other in like fashion. This, in turn, allows the adjustment of the bow grip for wrist height while simultaneously preserving its anti-torque pivoting capabilities.

DETAILED DESCRIPTION OF THE PREFERRED EMBODIMENT

Figure 1:
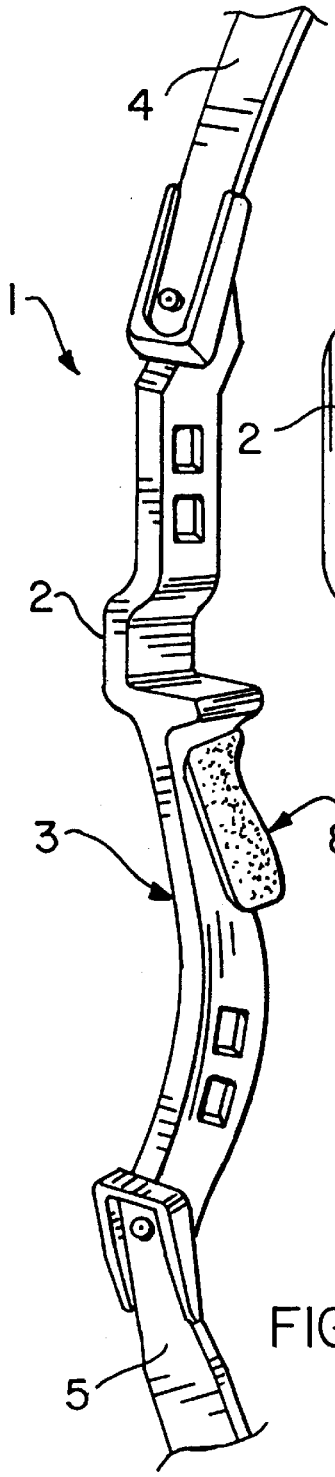
FIG. 1 provides a perspective view of a multi-purpose bow grip assembly in accordance with the teachings of this invention in place on the handle/riser of a bow.
Figure 3:
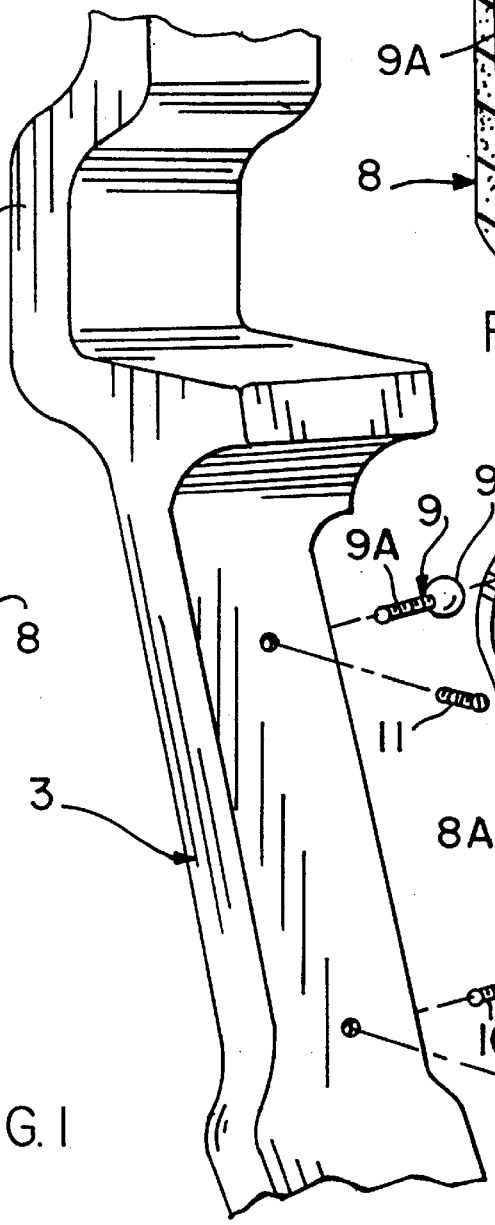
FIG. 3 provides a cross-sectional view through 3—3 of FIG. 4 of the multi-purpose bow grip assembly taught herein.
Figure 3:
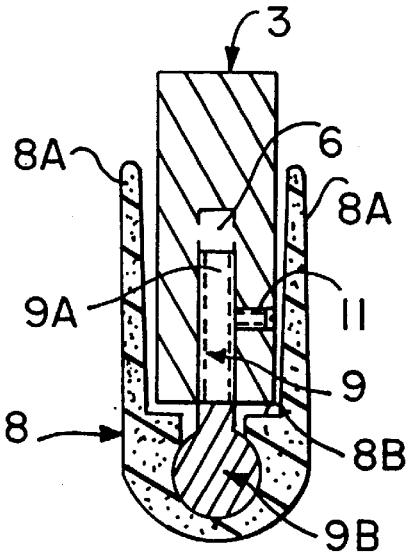
Figure 2:
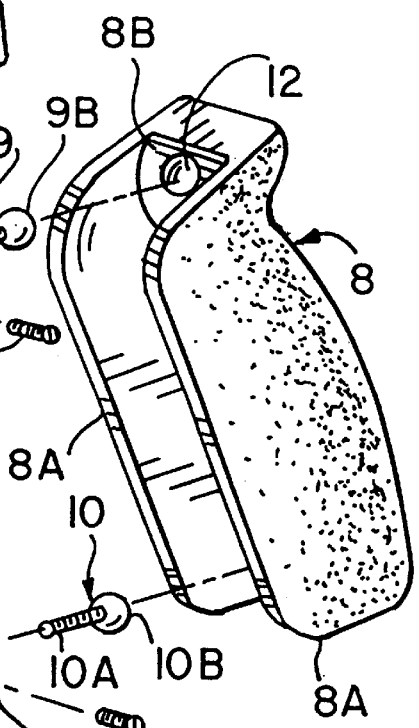
FIG. 2 provides a more detailed exploded perspective view of the components of a multi-purpose bow grip assembly in accordance with the teachings of this invention.

As will be noted from review of the drawing figures, the typical archery bow (denoted generally by arrow 1) has a central riser 2 with a handle portion (denoted generally by arrow 3) adapted to be gripped by an archer. The string (not shown) of bow 1 is strung either directly between, or from cams and pulleys connected to, upper limb 4 and lower limb 5. The elongate handle portion 3 typically has a width from front to rear greater than the thickness of said handle portion from side to side and a height greater than its width. In prior art designs currently in production, a contoured hand grip is sometimes rigidly connected to the bow 1 on the handle portion 3. However, in the preferred embodiment of the instant invention, as illustrated in FIGS. 1 through 9, the rigid hand grip connection typical of current designs is replaced by the multi-purpose bow grip assembly taught herein.

As will be noted from the drawing figures, the handle portion 3 of the instant invention is provided with two generally transverse front-to-back cylindrical bores. First bore 6 has its aperture on the rear of said handle portion 3. Likewise, second bore 7 is also provided with an aperture on the rear of said handle portion 3. Ideally, these bores to not extend through to the front of the handle portion 3, are substantially parallel to each other, and are substantially perpendicular to the longitudinal and side-to-side axes of the handle portion 3.

Each of the aforesaid bores is provided with a matching connective member by which it is connected to the handgrip (denoted generally by arrow 8). Thus, a first connective member (denoted generally by arrow 9) is provided having (i) a linear portion 9*a* adapted for insertion to varying depths into said first bore 6 via its aperture in bow handle 3 and (ii) a spherical head portion 9*b*. Likewise, a second connective member (denoted generally by arrow 10) is provided having (i) a linear portion 10*a* adapted for insertion to varying depths into said second bore 7 via its aperture in bow handle 3 and (ii) a spherical head portion 10*b*. The preferred embodiments illustrated utilize ball bearing studs with a head diameter of ⅜", a length of 1" and a shaft width of ¼" for first connective member 9 and second connective member 10.

To insure that connective member 9 and connective member 10 may be nonpermanently affixed at any of a variety of depths within the previously described bores, some type of locking means must also be provided. In the preferred embodiment illustrated, this means includes both (i) the provision of engaging screw threading on the linear portion 9*a* of first connective member 9 and first bore 6 as well as on the linear portion 10*a* of second connective member 10 and second bore 7, and (ii) the provision of set screws 11 intersecting first bore 6 and second bore 7. (Set screws 11 are preferably nylon tipped so as to avoid damaging the threading of the connective members 9 and 10 and may be tightened in a variety or ways, such as by standard screw driver or by Allen Wrench). Either of these means could provide some ability to lock connective members 9 and 10 at desired and varying depths within handle 3. However, it is deemed most advantageous to include both.

Hand grip 8 has side walls 8*a* defining an inward channel 8*b* extending the length of handgrip 8 and a contoured back (to be held by the user) opposite inward channel 8*b*. As it must interface with, and snugly engage, the spherical head 9*b* of first connective member 9 and the spherical head 10*b* of second connective member 10 in order to be connected to the handle 3 by said connective members it is provided with matching sockets in inward channel 8*b*. The hand grip 8 is preferably formed from semi-rigid plastic materials; thus, the spherical heads 9*b* and 10*b* described can snap into (and out of) these sockets with only moderate effort by the archer. The first socket 12 has a round aperture in inward channel 8*b* intermediate side walls 8*a*. First socket 12 is adapted to snugly engage the spherical head 10*b* of first connective member 10 (and is, therefore, provided with a diameter approximately equal to the diameter of spherical head 10*b*). Handgrip 8 is also provided with an elongated second socket 13 having an elongated aperture in said inward channel 8*b* intermediate side walls 8*a*. Second socket 13 is, therefore, adapted to snugly engage the spherical head 10*b* of said second connective member 10 while allowing said spherical head 10*b* to slide within the second socket 13 intermediate side walls 8*a*. In the embodiment illustrated, utilizing the ball bearing studs previously described, second socket 13 may advantageously be provided with a length of approximately 1" and an aperture of approximately ¾".

The provision of an elongated socket makes several of the unique features of this invention possible. Without such a socket, the hand grip 8 could not be moved towards or away from the handle 3, varying brace height and draw length. Moreover, without such a socket, as sidewalls 8*a* are farther apart than the side-to-side width of handle 3, hand grip 8 can pivot (within a limited range) around an axis running through spherical heads 9*b* and 10*b* of connective members 9 and 10, assisting in the elimination of bow torque. However, as the positioning of spherical heads 9*b* and 10*b* at different distances from handle 3 increases the distance between them, hand grip 8 could not simultaneously be adjusted for either high wrist or low wrist positioning without such a socket. This ability is one of the truly unique features of the instant invention and sets it apart from all of the prior art known to the inventor and described herein.

Figure 4:
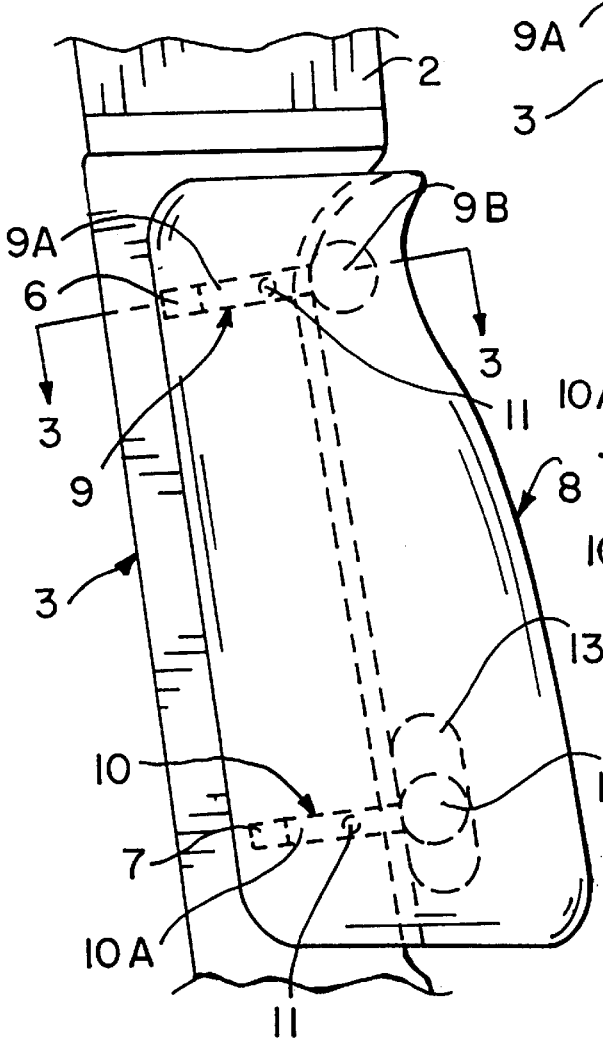
FIG. 4 provides a side view of the multi-purpose bow grip assembly taught herein in a first position wherein the bow grip does not abut the bow handle at top or bottom (making it free to pivot), and is evenly spaced from the bow handle (creating an intermediate wrist position).
Figure 5:
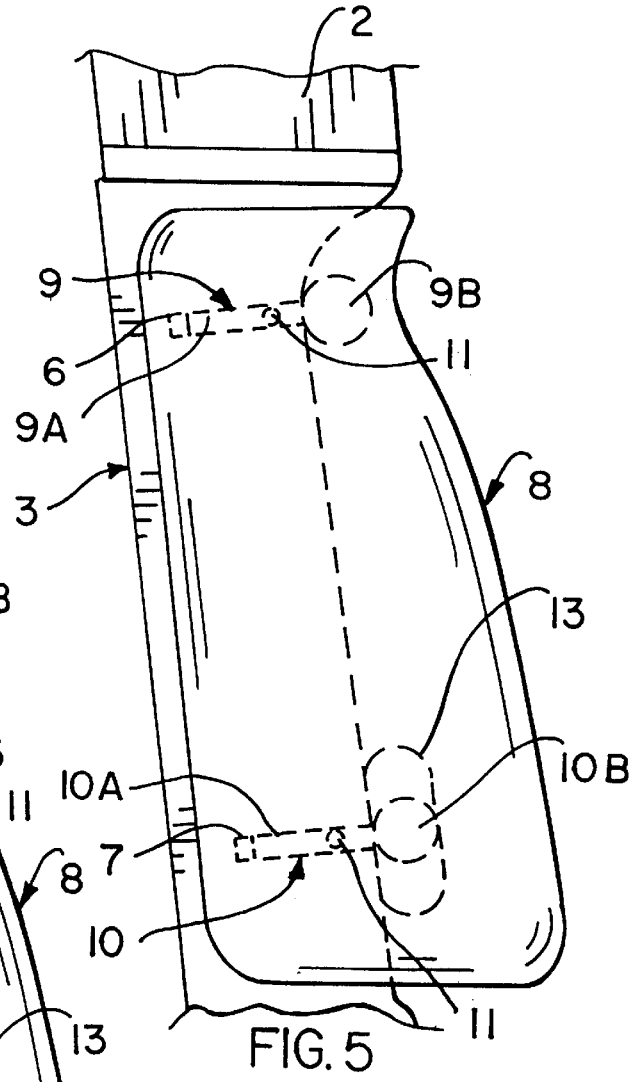
FIG. 5 provides a side view of the multi-purpose bow grip assembly taught herein in a second position wherein the bow grip rigidly abuts the bow handle at top and bottom (making it non-pivoting) and is adjacent to the bow handle at top and bottom (creating an intermediate wrist position).
Figure 6:
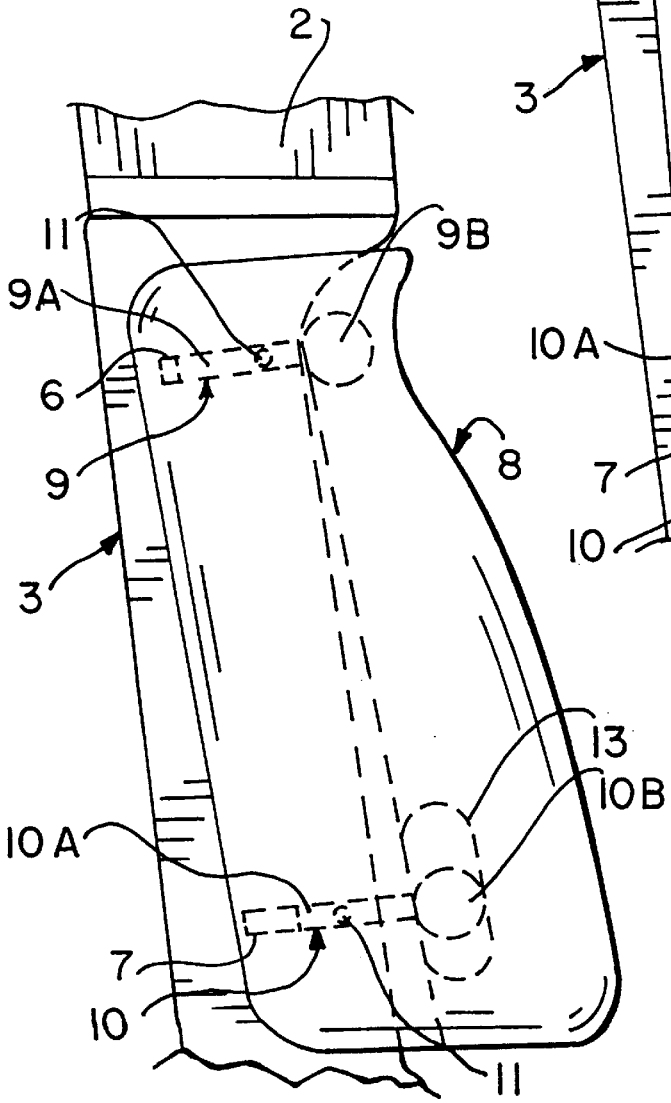
FIG. 6 provides a side view of the multi-purpose bow grip assembly taught herein in a third position wherein the bow grip rigidly abuts the bow handle at its top (making it non-pivoting) and is more distant from the bow handle at its bottom (creating a high wrist position).
Figure 7:
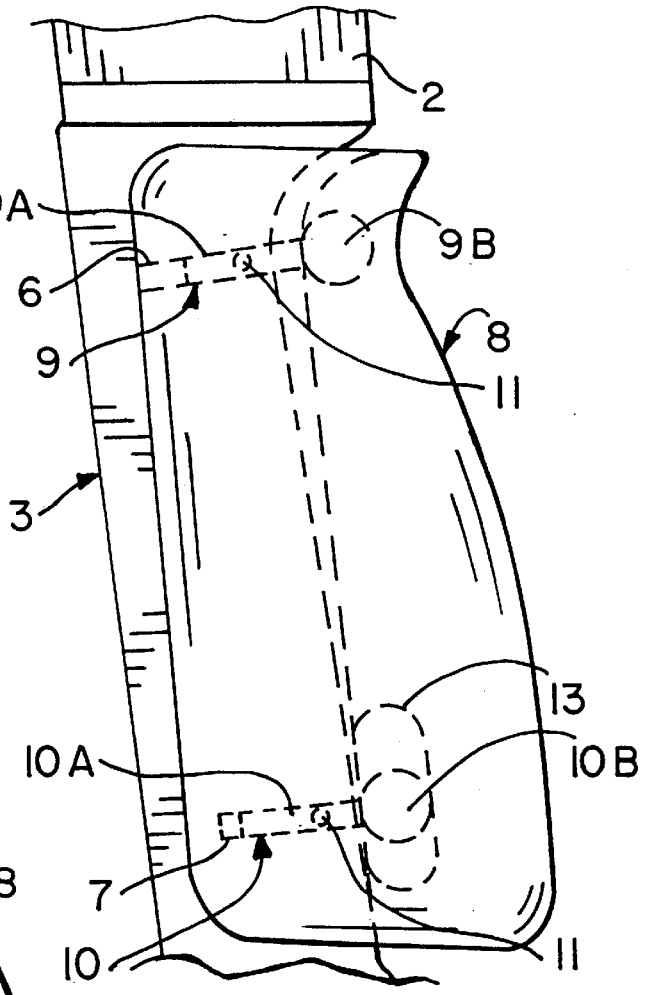
FIG. 7 provides a side view of the multi-purpose bow grip assembly taught herein in a fourth position wherein the bow grip rigidly abuts the bow handle at its bottom (making it non-pivoting) and is more distant at its top (creating a low wrist position).
Figure 9:
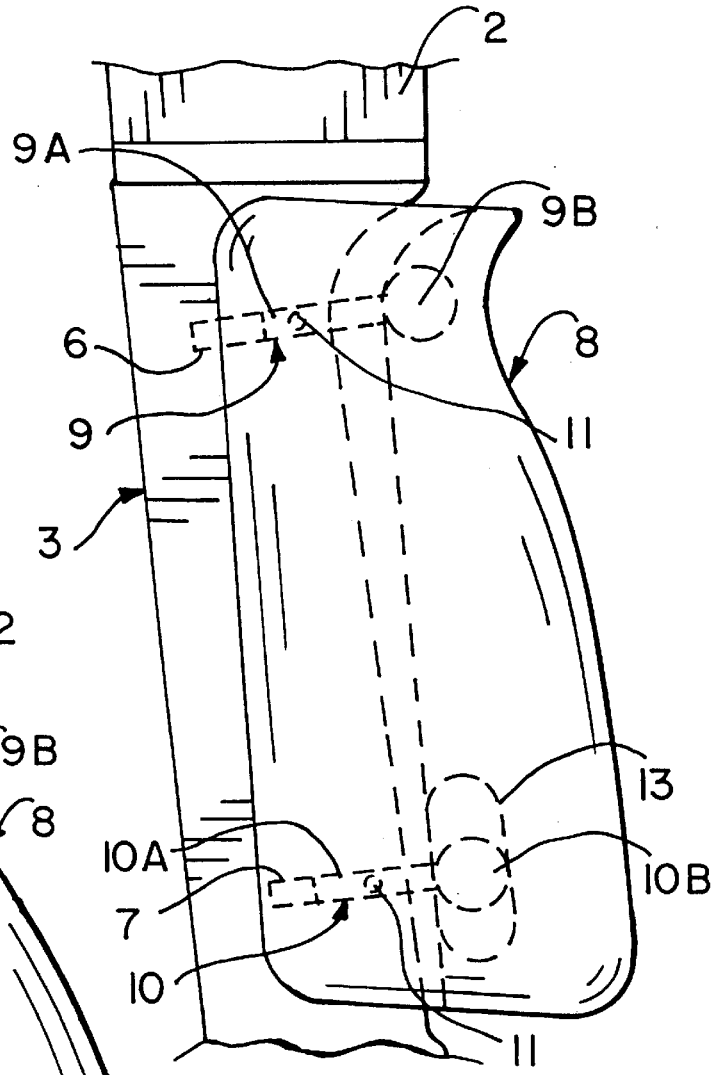
FIG. 9 provides a side view of the multi-purpose bow grip assembly taught herein in a sixth position wherein the bow grip does not rigidly abut the bow handle at top or bottom (making it pivoting) and is more distant at its top (creating a low wrist position).
Figure 8:
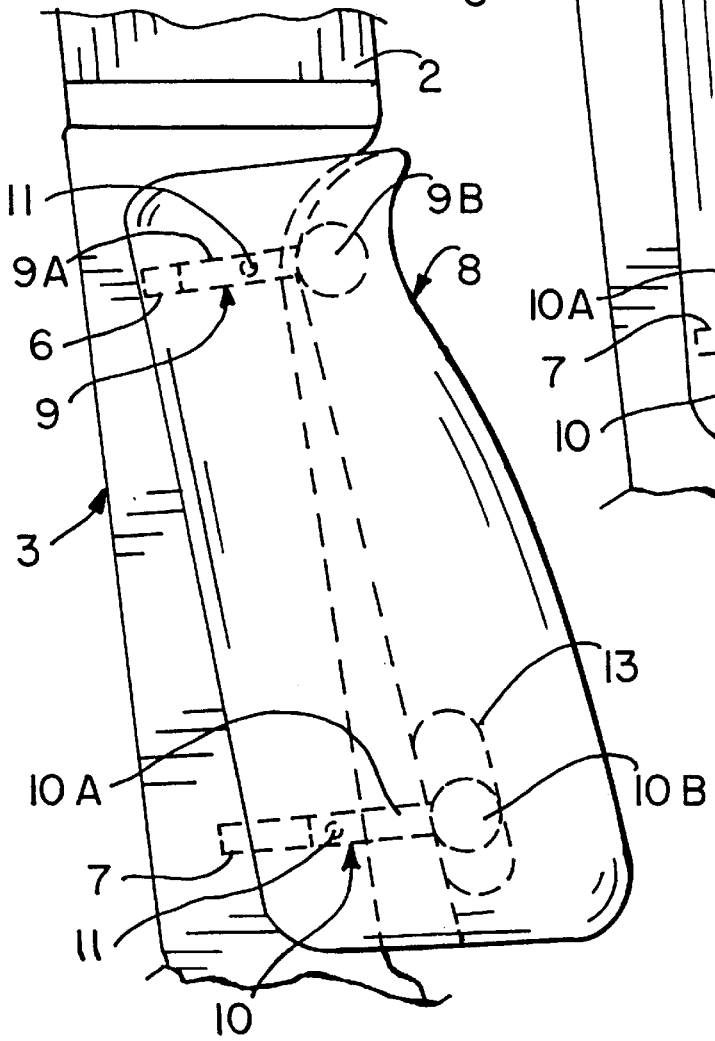
FIG. 8 provides a side view of the multi-purpose bow grip assembly taught herein in fifth position wherein the bow grip does not rigidly abut the bow handle at top or bottom (making it pivoting) and is more distant at its bottom (creating a high wrist position).
Figure 10:
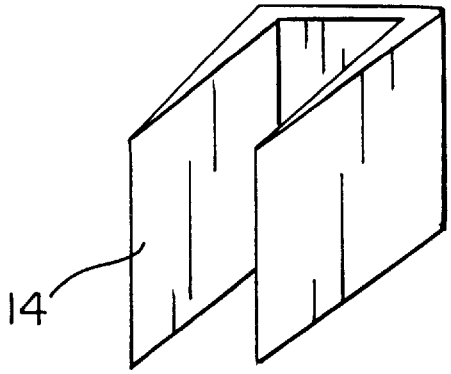
FIG. 10 provides a perspective view of connected shims which may be inserted between the bow grip and bow handle to prevent the bow grip from pivoting.

The versatility of the instant design is more fully appreciated in reviewing the various bow grip positions illustrated in FIGS. 4 through 9. In these figures it will be seen that the instant design allows something unavailable in prior art designs, the ability to set the bow grip at a full range of wrist positions from high to low, with the simultaneous ability to make the bow grip pivoting or non-pivoting and to adjust draw length. FIG. 4 illustrates the bow grip 8 of the instant invention in an intermediate pivoting position. It is neither high wrist nor low wrist, nor is it at full extension from the bow, allowing further shortening or increase of draw length by moving bow grip 8 towards or away from the bow handle 3. FIG. 5 illustrates the bow grip 8 of the instant invention snugly adjacent to bow handle 3. In this position it is neither high wrist nor low wrist and is non-pivoting. FIG. 6 illustrates the bow grip 8 with its lower portion out (creating a high wrist position for the archer) and its upper portion snugly abutting the bow handle 3 (making it non-pivoting). FIG. 7 illustrates the bow grip 8 with its upper portion out (creating a low wrist position for the archer) and its upper portion snugly abutting the bow handle 3 (making it non-pivoting). FIG. 8 illustrates the bow grip 8 with its lower portion out farther than its upper portion, but with neither abutting the bow handle 3, creating a high wrist position for the archer with pivoting of bow grip 8. FIG. 9 illustrates the bow grip 8 with its upper portion out farther than its lower portion, but with neither abutting the bow handle 3, creating a low wrist position for the archer with pivoting of bow grip 8. Any of these positions may be created simply and easily by unsnapping the bow grip 8, adjusting connective members 9 and 10 for the position desired by screwing same in/out of bow handle 3, tightening set screws 11, and snapping the bow grip 8 back onto spherical heads 9*b* and 10*b* of connective members 9 and 10.

The aforesaid positionings do not, however, exhaust the possibilities of the instant design. Numerous other combinations are possible. Moreover, as will be noted, side walls 8*a*, which limit the amount bow grip 8 is free to pivot, also allow bow grip 8 to be fixed and rigid at any degree of extension from bow handle 3 (allowing maximum adjustability of brace height and draw length without pivoting) by the simple expedient of adding shims between side walls 8*a* and bow handle 3. These shims may be separate members or may, preferably, be united to each other so as to create a single shim member 14 with a "U" shaped cross section that snaps into place either across the front of the bow (on the side facing away from the archer) or under the bow grip 8 (on the side facing the archer). Once inserted, single shim member 14 prevents pivoting by filling the gap between side walls 8*a* and bow handle 3. Further, although not as versatile as the preferred embodiment illustrated, it is possible to reverse the design so as place the ball and socket joints of the instant configuration within the bow handle 3 rather than the bow grip 8. These and numerous other variations are possible without exceeding the ambit of the instant invention, which is best determined by the claims that follow.

I claim:

1. An archery bow having a central riser member with a handle portion adapted to be gripped by an archer, the bow comprising:

(a) an elongate handle portion having a front, a rear, and two sides, the width from front to rear and the thickness from side-to-side being less than the longitudinal height of said elongate handle portion, said handle portion being provided with (i) an upper bore having its aperture on the rear of said handle portion and (ii) a lower bore having its aperture on the rear of said handle portion below the aperture of the upper bore, said upper bore and said lower bore being substantially parallel to each other and substantially perpendicular to the longitudinal axis and the side-to-side axis of the elongate handle portion;

(b) a first connective member, said first connective member having (i) a linear portion adapted for insertion to varying depths into said upper bore and (ii) a spherical head portion;

(c) a first locking means for nonpermanently affixing the linear portion of said first connective member at any of a plurality of selected depths within said upper bore;

(d) a second connective member, said second connective member having (i) a linear portion adapted for insertion to varying depths into said lower bore and (ii) a spherical head portion (e) a second locking means for nonpermanently affixing the linear portion of said second connective member at any of a plurality of selected depths within said lower bore; and (f) a handgrip having a pair of side walls defining an inward channel extending the length of said handgrip and a contoured back opposite said inward channel, wherein (i) said handgrip is provided with a first socket having a round aperture in said inward channel intermediate said side walls which said first socket is adapted to snugly engage the spherical head of said first connective member, (ii) said handgrip is provided with a second socket having an elongated aperture in said inward channel intermediate said side walls which said second socket is elongated and adapted to snugly engage the spherical head of said second connective member while allowing said spherical head to slide within said second socket intermediate said side walls, and (iii) the distance between said side walls is greater than the thickness of said handle portion.

2. An archery bow as described in claim 1, further comprising two shims linked by a shim connecting member, said shims being adapted to fit between the sides of the bow grip and the bow handle so as to eliminate pivoting of the bow grip.

3. An archery bow as described in claim 1, wherein said first locking means includes the provision of a screw threaded locking bolt engaged in a screw threaded bore transverse to said upper bore.

4. An archery bow as described in claim 3, further comprising two shims linked by a shim connecting member, said shims being adapted to fit between the sides of the bow grip and the bow handle so as to eliminate pivoting of the bow grip.

5. An archery bow as described in claim 1, wherein said second locking means includes the provision of a screw threaded locking bolt engaged in a screw threaded bore transverse to said lower bore.

6. An archery bow as described in claim 5, further comprising two shims linked by a shim connecting member, said shims being adapted to fit between the sides of the bow grip and the bow handle so as to eliminate pivoting of the bow grip.

7. An archery bow as described in claim 1, wherein said first locking means includes the provision of matching screw threading on the linear portion of the first connective member and within the upper bore such that the first connective member engages said matching screw threading in the upper bore when inserted therein.

8. An archery bow as described in claim 7, further comprising two shims linked by a shim connecting member, said shims being adapted to fit between the sides of the bow grip and the bow handle so as to eliminate pivoting of the bow grip.

9. An archery bow as described in claim 1, wherein said second locking means includes the provision of matching screw threading on the linear portion of the second connective member and within the lower bore such that the second connective member engages said matching screw threading in the lower bore when inserted therein.

10. An archery bow as described in claim 9, further comprising two shims linked by a shim connecting member, said shims being adapted to fit between the sides of the bow grip and the bow handle so as to eliminate pivoting of the bow grip.

* * * * *